United States Patent [19]

Melcher et al.

[11] 4,261,536

[45] Apr. 14, 1981

[54] DEVICE FOR CONTROLLING THE OPERATING CYCLES OF MODELS

[76] Inventors: Hans Melcher, Scheibenstr. 14, 7570 Baden-Baden; Richard Schwägerl, Hindenburgstr. 9, Gaggenaw 1, both of Fed. Rep. of Germany

[21] Appl. No.: 28,462

[22] Filed: Apr. 9, 1979

[30] Foreign Application Priority Data

Nov. 3, 1978 [DE] Fed. Rep. of Germany ... 7832636[U]

[51] Int. Cl.[3] ..... B64C 31/06; B64C 17/00

[52] U.S. Cl. ..... 244/155 A; 74/424.8 R; 74/89.15; 192/141; 244/75 R; 244/93; 192/143

[58] Field of Search ..... 318/9, 10, 14, 15; 74/424.8 R, 89.15; 192/141, 143; 46/248, 249, 262; 244/155 A, 93; 64/2 R

[56] References Cited

U.S. PATENT DOCUMENTS

| | | | |
|---|---|---|---|
| 1,450,284 | 4/1923 | Goldschmidt | 64/2 R |
| 3,718,215 | 2/1973 | Mimeur | 192/141 |
| 3,960,346 | 6/1976 | Cho | 244/155 A |
| 3,985,320 | 10/1976 | Brady | 244/93 |
| 4,053,040 | 10/1977 | McGourty | 74/89.15 X |

*Primary Examiner*—Galen L. Barefoot

*Attorney, Agent, or Firm*—Allison C. Collard; Thomas M. Galgano

[57] ABSTRACT

A device for controlling the movements or operating cycles of models, for example, model airplanes, model ships, kites, etc., which are driven by a drive motor is provided which includes a screw spindle which is affixed at about the center of a shaft which is coupled with the motor drive shaft. An internally-threaded element, preferably a nut, is longitudinally guided on the screw spindle for actuating the operating cycle in one or the other direction. At the two protruding ends of the shaft, a spiral spring is disposed which urges a washer against the screw spindle in such a way that when the element becomes unscrewed from either end of the screw spindle, the element is retained in a free-running position, and during the reverse rotation of the motor drive shaft, the element is pushed in a counter direction whereupon it is screwed onto the screw spindle.

5 Claims, 5 Drawing Figures

DEVICE FOR CONTROLLING THE OPERATING CYCLES OF MODELS

This invention relates to a device for controlling operating cycles in toy models, for example, model airplanes, model ships, kites, etc., which are driven by suitable drive motors, for example, electric or gasoline-powered motors or any other suitable motors.

A variety of devices for controlling the operating cycles in models are already known, in particular, controls in the form of servo-units or servomechanisms which are driven by a motor, for example, an electric motor. These known drives have a rather complicated gear wheel or worm gear coupling mechanism. Therefore, the hitherto known devices are relatively heavy and expensive.

It is therefore an object of the present invention to provide a control means of the aforementioned type which is not only considerably lighter than the hitherto known control devices, but which is also substantially simplified and is, therefore, more economical.

In order to attain this object of the invention, a device for controlling the operating cycles in models, for example, model airplanes, model ships, kites, or the like, is provided which is driven by a suitable drive motor and which is characterized by the provision of an externally-threaded screw spindle which is stationarily mounted at about the center of a shaft which is coupled (or may be coupled) with a motor drive shaft. An element or a nut is longitudinally guided on the screw spindle, the former of which is provided with a corresponding internal thread for actuating the operating cycle in the one or the other direction. Two protruding ends of the shaft are provided with spiral springs which press from opposite sides against washers and against the screw spindle in such a way that, during the running out of the element or the nut (i.e., when the nut becomes unscrewed from an end of the spindle), the element or the nut is retained in a free running position. During reverse rotation of the motor drive shaft, the element or the nut is pushed in a counter direction so that it is screwed onto the spindle.

In order to guide the element or the nut in a longitudinal direction, the same is preferably coupled with a guide rod sliding in a slide guide. The guide rod is, in turn, coupled with the means for carrying out the desired operating movement.

The device in accordance with the present invention has the substantial advantages that it can be simply and easily constructed, and that it eliminates undue stresses on smaller model airplanes or kites. Due to the light weight and the simplicity of the control device made in accordance with the invention, a plurality of such control devices can be comfortably installed in the same toy model so as to carry out a plurality of operating cycles, without exceeding the admissible payload.

The control device in accordance with the invention can be driven with any suitable motor, for example, an electric motor or a gasoline-powered motor. In addition, a particular advantage is that the guide rod which is coupled with the element or nut may be directly coupled to a control mechanism or pivotable control lever or with the throttle of a drive motor.

The control device in accordance with the invention has the further advantage that it can be used in a simple way for displacing weights mounted in or on kites and therefore, the device may be used for controlling the movement of kites. In such a case, the element or the nut may be directly coupled with the weight, movement of the latter of which causes the kite to change its position. It is also advantageous that, for example, two devices may be mounted onto the two ends of the motor shaft, as a result of which the weight displacement is obtainable by two separated mounted weights. In particular, in a kite, two motor drives may be arranged at a right angle with respect to each other, whereby a simple weight displacement permits one to execute height and said adjustments of the kite position.

Other objects and features of the present invention will become apparent from the following detailed description when taken in connection with the accompanying drawings which disclose several embodiments of the invention. It is to be understood that the drawings are designed for the purpose of illustration only, and are not intended as a definition of the limits and scope of the invention.

In the drawings, wherein similar reference characters denote similar elements throughout the several views.

Figure 1:
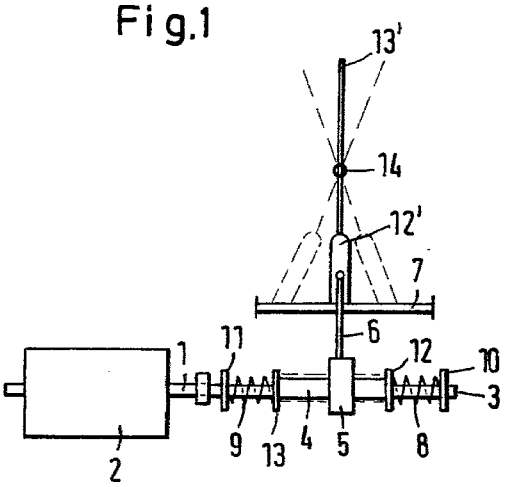
FIG. 1 is a side elevational view of a first embodiment of a device embodying the present invention.

Referring now in detail to the drawings, as can be seen from FIG. 1, therein is illustrated a device according to the present invention which includes a shaft 3 mounted on the end of a drive shaft 1 of a motor 2 which, for example, may be an electric motor and which shaft can be brought into an idle position from two rotational directions by means of known, conventional control means. Shaft 3 is either directly coupled to motor shaft 1 or merely constitutes an extension thereof. An externally-threaded screw spindle 4 is mounted on shaft 3 at the center thereof. An element 5, for example, a nut with an internal thread, is screwed onto screw spindle 4. The nut moves easily on the screw spindle 4 and is provided with a guide rod 6 which runs in slide guide 7. By rotating motor shaft 1, and thereby shaft 3, element 5 (i.e., the nut) is either moved to the right or left side, depending on the direction of the rotational movement.

Spiral springs 8 and 9 are disposed on the two outer protruding ends of shaft 3 and each abut one of a pair of washers 10 and 11 which are stationarily mounted or affixed on shaft 3. Spiral springs 8 and 9 serve, respectively, to press loosely mounted or freely-movable washers 12 and 13, against the screw spindle from opposite sides thereof.

When element 5, which is provided with an internally-threaded bore, reaches the one or the other end of screw spindle 4, depending on the rotational direction of the motor drive shaft 1, element 5 is completely released from screw spindle 4 and runs free or remains freely suspended at this end position during the further rotation of motor drive shaft 1. However, element 5 is constantly pushed against screw spindle 4 by means of washer 12 or 13, respectively, and the corresponding spring 8 or 9. As a result, motor 2 is not overloaded, since element 5 (or the nut) runs freely. When the rotational direction of drive shaft 1 of motor 2 is reversed, the corresponding spring 8 or 9 pushes element 5 onto spindle 4, the latter of which enters into the bore of element 5 until the element is again screwed on, at which point it can then be moved in either direction. Thereby, guide rod 6 is either moved to the right or the left, because the guide rod is maintained in slide guide 7.

A particular advantage of such a drive system is that at each position, a switching over or reversing of the motor drive direction can be performed, so that a different control movement occurs. However, it is not required, as is the case in known servo-units, that the control movement must be moved against an abutment in order to perform a reverse movement. Instead, the control movement can be moved into one or the other direction at each given position by reversing the drive direction of motor 2 and, in turn, element 5.

The front end of guide rod 6 engages by means of a bolt or pin into a recess 12' of a control lever, rudder or control mechanism 13' which is pivotably mounted on a pivot 14 and which supports at its outer end a suitable control or servo-mechanism (not shown). Naturally, instead of the servo-mechanism a throttle for a drive motor, etc., may be provided.

Figure 2:
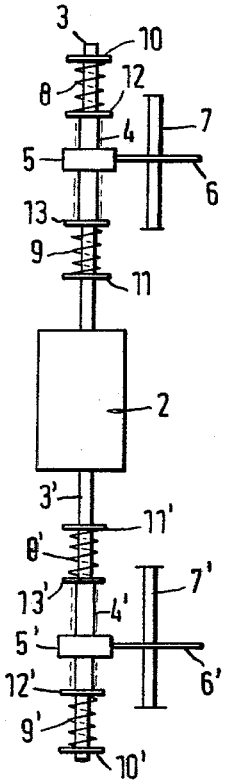
FIG. 2 is side elevational view of a further embodiment of the present invention.

FIG. 2 illustrates a different embodiment from that of FIG. 1 in which two control devices are provided on both ends of motor 2; the second control device is designated with the reference numerals 3' to 11', and wherein guide rods 6 and 6' can perform the same or counter running movements depending on the arrangement of the screw thread.

Figure 3:
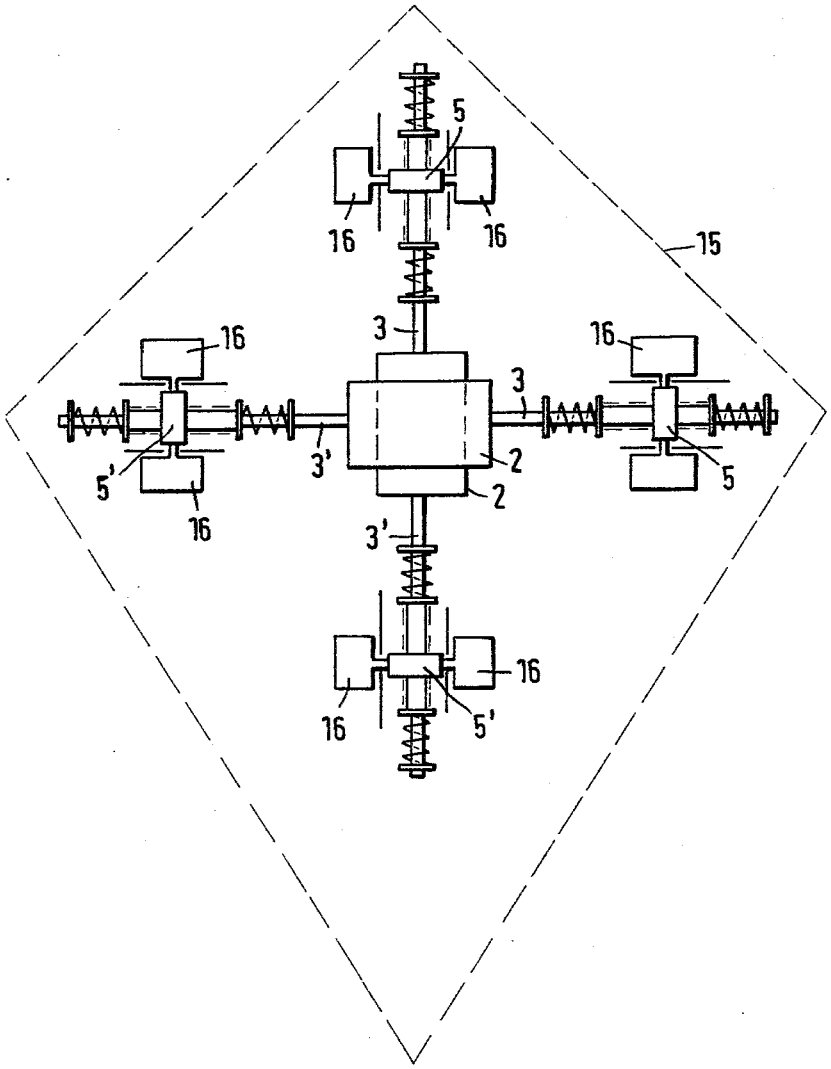
FIG. 3 is a side elevational view showing one principal arrangement of the device in accordance with the invention for controlling a kite, the latter of which is shown in phantom line.

FIG. 3 illustrates a different control device made in accordance with the present invention which may be used for the height and side control of a drive, for example. Therefore, two controls in accordance with FIG. 2 are mounted at a right angle with respect to each other underneath kite 15, as shown in phantom line. Weights 16 are mounted on each of the elements 5; elements 5 again being provided with internally-threaded bores so that these weights may be moved upwardly or downwardly, or to the right and left, depending on the control of the two motors 2. Thereby, it is possible to provide the kite with a height and side control which can be activated from the ground by means of a corresponding guide line or a wireless control mechanism, for example.

Naturally, further embodiments are possible, wherein the control device in accordance with the invention could be used. A particular advantage is that they can be easily structured and are therefore relatively simple and inexpensive.

Figure 4:
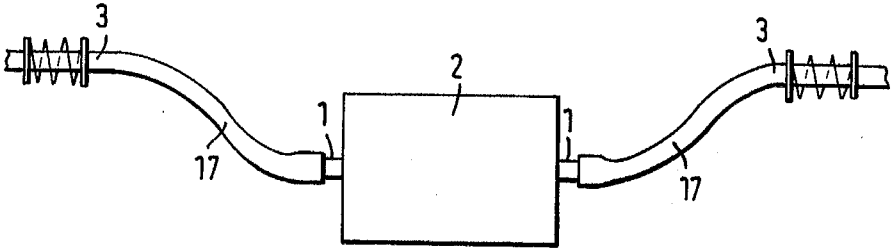
FIG. 4 is a side elevational view of another embodiment of the present invention.

FIG. 4 illustrates a further embodiment of the device in accordance with the invention, wherein on both ends of shaft 1 of motor 2 two yieldable shafts 17 and 17' are mounted which are coupled with shafts 3, 3', respectively. In this way, it is possible to displace the motor axially with respect to shafts 3 or 3' or to position the shaft 3 or 3' at a given angular disposition relative to the axis of motor shaft 1.

Figure 5:
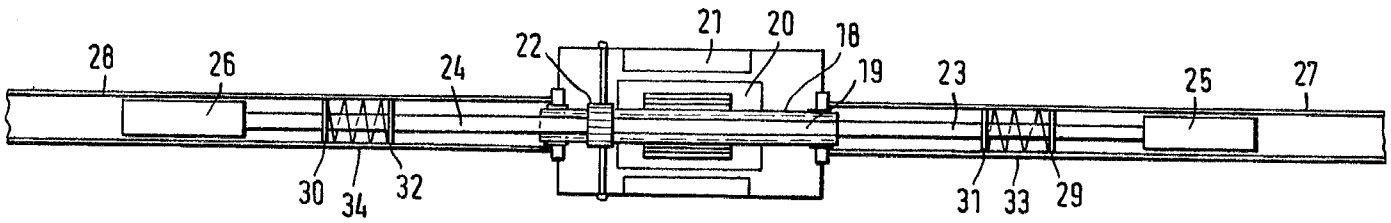
FIG. 5 is a side elevational view of still another embodiment of the present invention.

FIG. 5 illustrates still another embodiment of the invention wherein the principle of the invention is maintained in a somewhat reversed manner. Instead of element 5 which is provided with the internally-threaded bore, a motor shaft 18 is provided with a continuous, internally-threaded bore, in which a screw spindle 19 is longitudinally displaceable. Motor shaft 18 is coupled with a rotor 20. Furthermore, the motor is provided with a stator 21 and a collector 22. On opposite ends of screw spindle 19, two protruding shafts 23 and 24 are provided, each of which respectively carry or support a weight 25 and 26 at their outermost ends. Protruding shafts 23, 24 and the weights 25, 26, each run within one of two tubes 27 and 28. Stationary washers 29 and 30 are mounted within these tubes, as well as two loose or freely-movable washers 31 and 32. Shafts 23 and 24 each extend respectively through a pair of washers 29, 31 and 30, 32. Spiral springs 33,34, are provided between the washers in such a way that the inner loose washers are pressed against the end of the screw spindle when the spindle is screwed out from the internal thread of hollow axle or shaft 18. Consequently, screw spindle 19 will be pushed against the internal thread when in a free running or non-threadably-engaged position. When reversing the rotational direction of the motor shaft, screw spindle 19 is again screwed into the internal thread of hollow shaft 18 until it discharges from the other end where the same operation is repeated. Naturally, the two weights on the outer ends may be replaced by any given guide means for different control tasks, for example, for controlling servo-units or throttle arms or flaps.

With respect to the FIG. 5 embodiment, it should be noted that in order to ensure relative movement between the internally-threaded shaft 18 and the externally-threaded screw spindle 19, a guide rod 6 and slide guide 7 as shown in FIGS. 1–2 could be used. Alternatively, weights 25 and 26, as well as guide tubes 27 and 28, at least in the zone of weights 25 and 26, may be provided with a corresponding non-round or multi-cornered cross-sectional configuration so that a rotation of the weights relative to the tubes is made impossible.

Thus, while only several embodiments of the present invention have been shown and described, it will be obvious to those persons of ordinary skill in the art, that many changes and modifications may be made thereunto, without departing from the spirit and scope of the invention.

What is claimed is:

1. A device for controlling the operational movement cycles of models driven by a drive motor having a drive shaft, comprising:

a support shaft coupled to said drive shaft for rotation therewith;

an externally-threaded screw spindle mounted at about the center of said support shaft;

an element having an internally-threaded bore extending therethrough which is threadably receivable on said spindle for longitudinal oscillating displacement therealong;

a pair of stationary washers secured to said support shaft, each of said stationary washers being spaced from an opposite end of said spindle;

a pair of freely-movable washers received on said support shaft, each of said freely-movable washers being disposed between an opposite end of said spindle and the stationary washer spaced therefrom;

a pair of spiral springs received on said support shaft, each of said spiral springs being disposed between one of said stationary washers and one of said freely-movable washers so as to bias said freely-movable washers against the end of the spindle associated therewith so that upon threaded disengagement of said element from either end of said spindle, said element is retained in a free-running position, and so that, upon reverse rotation of the motor drive shaft, said element is urged in a counter-direction so as to effect threaded engagement thereof with said screw spindle;

a slide guide rod coupled to said element and slidably received in a slide guide for facilitating the longitudinal displacement of said element; and a control lever of a control mechanism coupled to said guide rod for carrying out a control movement, said control lever serving as a throttle for a model drive motor.

2. The device according to claim 1, wherein said support shaft is coupled to said motor drive shaft by means of a flexible shaft.

3. A device for controlling the operational movement cycles of models driven by a drive motor having a drive shaft with an internally-threaded axial bore, comprising:

an externally-threaded screw spindle which is threadably receivable in said bore of said drive shaft;

a pair of extension shafts secured to opposite ends of said spindle;

a pair of tubes in which said shafts are longitudinally displaceable;

a pair of stationary annular washers mounted within said tubes through each of which one of said extension shafts extends, each of said washers being spaced from an opposite end of said spindle;

a pair of freely-movable washers mounted within said tubes through each of which one of said extension shafts extends, each of said freely-movable washers being disposed between an opposite end of said spindle and the stationary washer spaced therefrom;

a pair of spiral springs, each of which is received on one of said extension shafts between one of said stationary washers and one of said freely-movable washers for biasing said freely-movable washers towards said spindle; and a control mechanism mounted on the ends of each of said extension shafts.

4. The device according to claim 3, wherein said control mechanism comprises a weight.

5. A device for controlling the operational movement cycles of models driven by a drive motor having a drive shaft, comprising:

a support shaft coupled to said drive shaft for rotation therewith;

an externally-threaded screw spindle mounted at about the center of said support shaft;

an element having an internally-threaded bore extending therethrough which is threadably receivable on said spindle for longitudinal oscillating displacement therealong;

a pair of stationary washers secured to said support shaft, each of said stationary washers being sapced from an opposite end of said spindle;

a pair of freely-movable washers received on said support shaft, each of said freely-movable washers being disposed between an opposite end of said spindle and the stationary washer spaced therefrom;

a pair of spiral springs received on said support shaft, each of said spiral springs being disposed between one of said stationary washers and one of said freely-movable washers so as to bias said freely-movable washers against the end of the spindle associated therewith so that upon threaded disengagement of said element from either end of said spindle, said element is retained in a free-running position, and so that, upon reverse rotation of the motor drive shaft, said element is urged in a counter-direction so as to effect threaded engagement thereof with said screw spindle; and wherein said support shaft, said element, said pairs of washers and springs comprise a set and wherein said device comprises two sets which are coupled to opposite ends of said motor drive shaft and wherein said device additionally includes a second motor having a drive shaft and two additional sets which are coupled to opposite ends of said second motor drive shaft, the first-mentioned drive motor with said two sets, and said second drive motor with said two additional sets being disposed at a right angle with respect to one another for securement to the underside of a kite and said elements of each of said sets having weights secured thereto for movement therewith along said spindles thereof.

* * * * *